US006612559B2

(12) United States Patent
Boss

(10) Patent No.: US 6,612,559 B2
(45) Date of Patent: Sep. 2, 2003

(54) CONVEYING DEVICE FOR COLLECTING AND TRANSPORTING PRINTED SHEETS PLACED ASTRADDLE ON A FIRST CHAIN CONVEYER

(75) Inventor: Heinz Boss, Strengelbach (CH)

(73) Assignee: GRAPHA-Holding AG, Hergiswil (CH)

( * ) Notice: Subject to any disclaimer, the term of this patent is extended or adjusted under 35 U.S.C. 154(b) by 0 days.

(21) Appl. No.: 10/055,744

(22) Filed: Jan. 23, 2002

(65) Prior Publication Data

US 2002/0101019 A1 Aug. 1, 2002

(30) Foreign Application Priority Data

Jan. 30, 2001 (EP) ..... 01810087

(51) Int. Cl.[7] ..... B65H 5/32

(52) U.S. Cl. ..... 270/52.18; 270/52.26; 270/52.29; 271/204; 271/205; 198/644

(58) Field of Search ..... 270/52.14, 52.16, 270/52.18, 52.26, 52.29; 271/82, 204, 205; 198/644, 470.1

(56) References Cited

U.S. PATENT DOCUMENTS

| | | | | | |
|---|---|---|---|---|---|
| 2,766,870 | A | | 4/1952 | Baker et al. | |
| 2,999,242 | A | * | 9/1961 | Young et al. | 227/1 |
| 3,317,026 | A | * | 5/1967 | Zugel et al. | 198/341.04 |
| 4,482,141 | A | | 11/1984 | Moser | |
| 4,489,930 | A | * | 12/1984 | Meier | 270/52.3 |
| 4,605,213 | A | * | 8/1986 | Hechler | 270/52.3 |
| 5,261,520 | A | | 11/1993 | Duke | |
| 5,660,382 | A | * | 8/1997 | Meier | 270/52.16 |
| 5,678,813 | A | * | 10/1997 | Osako et al. | 270/52.16 |
| 5,772,195 | A | * | 6/1998 | Mueller | 270/52.16 |
| 6,254,088 | B1 | * | 7/2001 | Kramer et al. | 271/204 |
| 6,315,107 | B1 | * | 11/2001 | Muller et al. | 198/606 |
| 6,478,297 | B1 | * | 11/2002 | Messerschmid | 271/277 |

FOREIGN PATENT DOCUMENTS

| | | | | | |
|---|---|---|---|---|---|
| EP | 0771675 | | | 5/1997 | |
| EP | 0976672 | A2 | * | 2/2000 | B65H/5/32 |
| GB | 2010784 | A | * | 7/1979 | B65H/5/32 |
| JP | 08143179 | A | * | 6/1996 | B65H/5/32 |
| WO | 9421544 | | | 9/1994 | |

OTHER PUBLICATIONS

Patent Abstracts of Japan, vol. 1996, No. 10, Oct. 31, 1996 & JP 08 143179 A (Sanko Seiki KK), Jun. 4, 1996.

* cited by examiner

*Primary Examiner*—Patrick Mackey
(74) *Attorney, Agent, or Firm*—Friedrich Kueffner

(57) ABSTRACT

A conveying device for collecting and transporting printed sheets has a first chain conveyor on which the printed sheets are placed astraddle to be conveyed in a conveying direction. A second chain conveyor is arranged downstream of the first chain conveyor in the conveying direction and synchronized with the first chain conveyor. An intermediate conveying device is arranged between the first and second chain conveyors and configured to grip intermediate products of collected printed sheets formed at the end of the collecting process on the first chain conveyor and to transport and transfer the intermediate products onto the second chain conveyor. The intermediate conveying device has a circulating traction mechanism and controllable grippers connected to the traction mechanism. The grippers grip a fold of the intermediate products lifted off the first chain conveyor and transport the intermediate products in an open position to the second chain conveyor.

15 Claims, 3 Drawing Sheets

CONVEYING DEVICE FOR COLLECTING AND TRANSPORTING PRINTED SHEETS PLACED ASTRADDLE ON A FIRST CHAIN CONVEYER

BACKGROUND OF THE INVENTION

1. Field of the Invention

The invention relates to a conveying device for collecting and transporting printed sheets placed astraddle on a first chain conveyor which printed sheets are gripped by an intermediate conveying device at the end of the collecting process on the first chain conveyor and then transported and transferred to a second chain conveyor or conveying device arranged downstream and synchronized with the first chain conveyor.

2. Description of the Related Art

Conveying devices of this kind are known inter alia in gather stitcher devices on which printed sheets are stitched at the end of a collecting process. It is moreover known to arrange two or more gather stitchers in series to be able to produce voluminous printed products wherein the final stitching action is carried out by the stitching station of the last gather stitcher in line while the stitching stations of the preceding gather stitchers are switched off. This combination of gather stitchers requires intermediate conveying devices between two gather stitchers which transport the intermediate products at the end of the collecting process on a first chain conveyor of a gather stitcher to a second chain conveyor of the successive gather stitcher, respectively.

A conveying device of this kind is disclosed in Japanese patent document JP-A-8/143179. The printed sheets which are collected on a first chain conveyor in the form of intermediate products positioned astraddle on the chain conveyor are moved by followers fastened on a circulating traction mechanism from the first chain conveyor via a stationary profiled guide rail onto a second chain conveyor. The guide rail projects with its ends into the conveying areas that are formed by the chain conveyors; the inlet area of the second chain conveyor requires a device which opens the intermediate products so that an interruption-free transfer is ensured.

Pushing the intermediate products on the trailing edge has several disadvantages. When the intermediate product is comprised of thin sheets, the trailing edge can be damaged by the impact of the follower provided for pushing, in particular, in the case of intermediate products that are heavy or have insufficient gliding properties, and this can impair the further processing of the intermediate products. Also, the transfer onto the second chain conveyor is complex in the case of intermediate products comprised of thin sheets. Pushing of relatively heavy intermediate products can cause markings or damage of the printed image at the inner edge of the fold.

In particular, the known intermediate conveying device is not suitable when the intermediate conveying stretch is curved or bent because pushing of an intermediate product at the trailing edge can result in deformations within the fold area which can cause disruptions during further processing.

These conditions represent impairments in regard to being able to provide an arrangement of the gather stitchers that deviates from the row-like, straight arrangement of several chain conveyors for the purpose of an optimal spatial distribution and arrangement.

SUMMARY OF THE INVENTION

It is an object of the present invention to provide a conveying device of the aforementioned kind in which the printed products are safely guided in the area of the intermediate conveying device and which makes it possible to connect two chain conveyors such that they have different conveying directions.

In accordance with the present invention, this is achieved in that the intermediate conveying device for gripping the intermediate products formed at the end of the collecting process on the first chain conveyor comprises controllable grippers which are connected to a circulating traction mechanism and grip the intermediate products, lifted off the first chain conveyor, in the area of the fold and transport them in an open position to the second chain conveyor.

In this way, the printed products are no longer pushed by followers between two chain conveyors but are gripped and guided by grippers and in this way transported from the first chain conveyor to the second chain conveyor. It would also be possible to provide, instead of the second chain conveyor, other continuously operating conveying devices which transport the intermediate products over sections of the transport stretch.

When according to a further embodiment of the invention the intermediate conveying device in the form of a gripping transporter comprises an articulated chain on which the grippers are arranged, it is possible to deflect the printed products on transfer from the first to the second chain conveyor into a conveying direction which is different from the conveying direction of the first chain conveyor. For example, a deflection of >0° up to 180° is possible. This has the important advantage that even very long conveying devices can be installed in a space-saving way. For example, such a conveying device can be installed in a corner of a building. For a deflection by 180°, the chain conveyors of two gather stitchers can be arranged parallel to one another. The conveying device can also be installed so as to extend over several floors of a building.

A particularly stable transfer from the first chain conveyor to the intermediate conveying device is ensured when according to a further embodiment of the invention a lifting device is provided which lifts intermediate products off the first chain conveyor. Such a lifting device according to a further embodiment of the invention comprises a lifting knife which is, for example, driven so as to perform an upward swinging movement. The grippers engage the intermediate products when positioned on the lifting knife. This provides for to secure and flowing transfer from the first chain conveyor to the intermediate conveying device.

A secure guiding of the printed sheets results when according to a further embodiment of the invention the grippers engage two locations of the intermediate products, the locations being spaced apart from one another. These locations are in the vicinity of the fold, preferably at the upper edge of the intermediate products and are offset in the transport direction. The intermediate products are then gripped especially securely and cannot be displaced during a flying transfer across a gap or cannot change their position in any other way.

DESCRIPTION OF THE PREFERRED EMBODIMENTS

Figure 1:
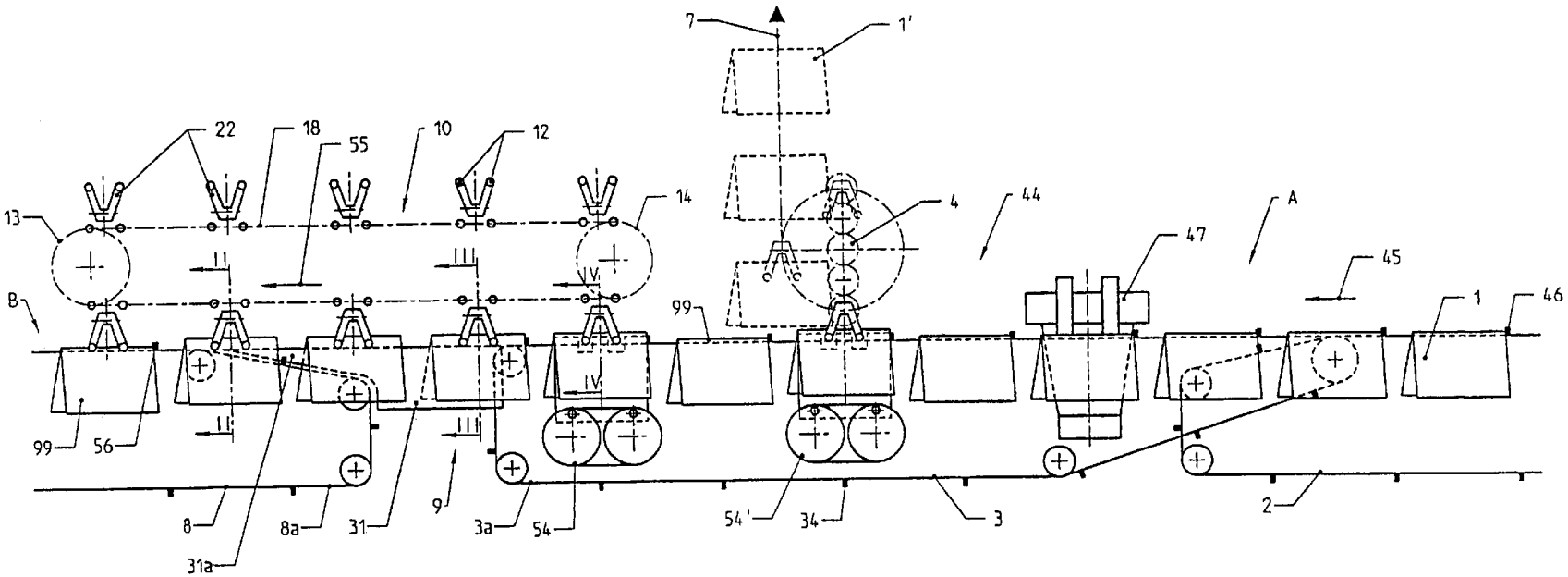
FIG. 1 shows a schematic view of the conveying device according to the invention.
Figure 4:
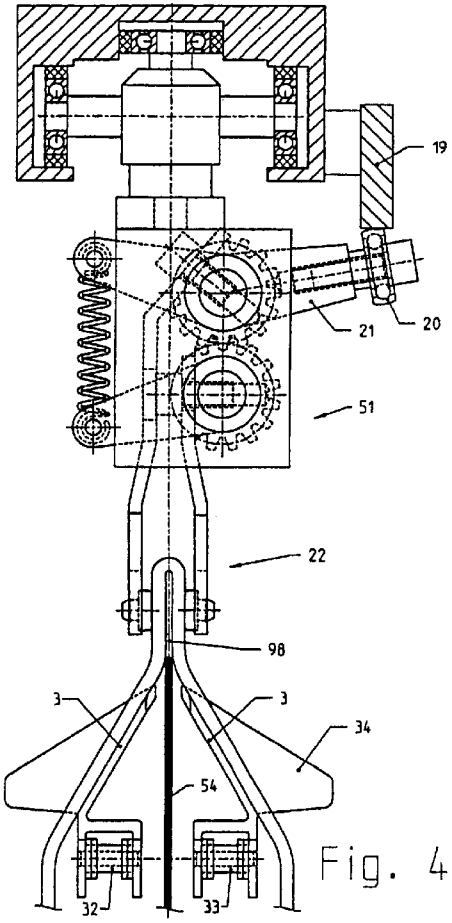
FIG. 4 shows a section along the section line IV—IV of FIG. 1.
Figure 5:
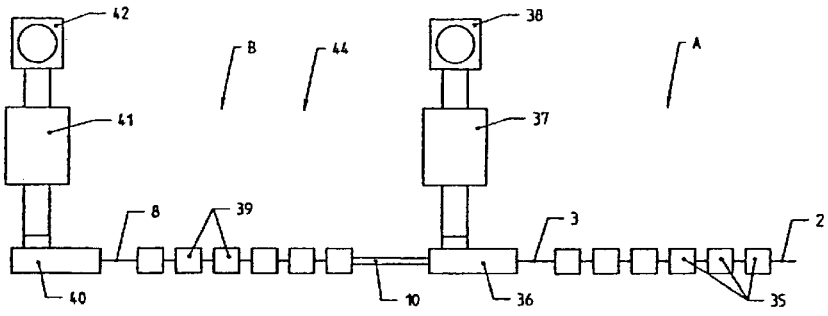
FIG. 5 shows schematically an arrangement of the conveying device according to the invention.

FIG. 1 shows a tandem gather stitcher 44 comprising a gather stitcher A and a gather stitcher B which are arranged inline. The two gather stitchers A and B can be basically of the same configuration. As illustrated, the gather stitcher A comprises a chain conveyor comprising a single chain 2 which, as is known in the art, transports printed sheets 1, in particular, folded printed sheets positioned astraddle on the chain 2, by means of followers 46 in the direction of arrow 45. Intermediate products 99 are collected printed sheets 1 which are not yet stitched. In the area of a double conveying and collecting chain 3 of the chain conveyor, the single chain 2 is lowered as is known in the art. The printed sheets 1 are transferred thus from the single chain 2 onto the double conveying chain 3. In the area of the double conveying chain 3 a stitching station 47 is arranged by which, as is known in the art, the collected printed sheets 1 are stitched along the fold. The stitching is carried out between the two chains 32 and 33 (FIG. 4) of the double conveying chain 3. Viewed in the transport direction, a delivery 4 is arranged downstream of the stitching station 47, with which the finished products 1' stitched by the stitching station 47 are lifted in the direction of arrow 7 off the gather stitcher A and can be fed, for example, to a trimming device 37 (FIG. 5).

Figure 3:
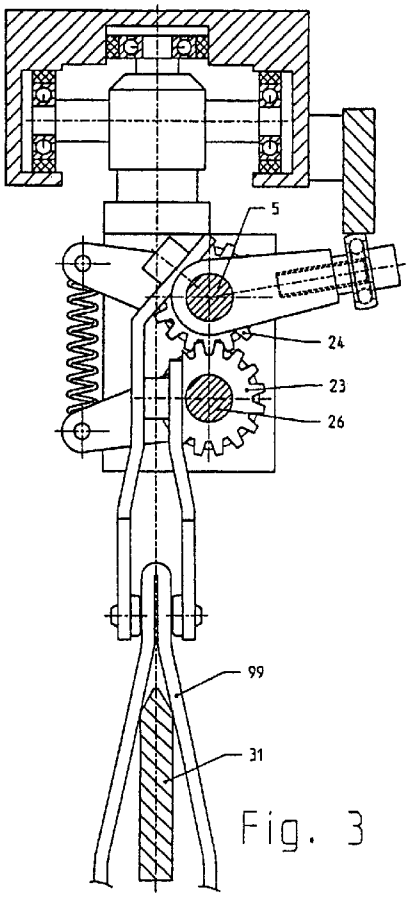
FIG. 3 shows schematically a section along the section line III—III.
Figure 2:
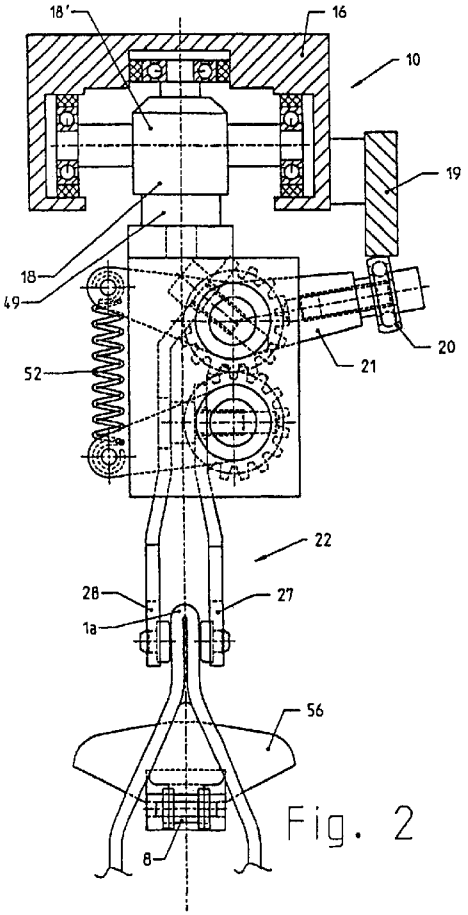
FIG. 2 shows schematically a section along the section line II—II.

Between the two gather stitchers A and B a gap 9 is provided which is bridged by an intermediate conveying device 10. This gap 9 is formed by the forward end 3*a* of the double conveying chain 3 and the rearward end 8*a* of a single chain 8 of the gather stitcher B. By means of the intermediate conveying device 10 the printed sheets in the form of intermediate products 99 are lifted off the double conveying chain 3 and supplied in the longitudinal direction to the single chain 8 of the gather stitcher B and placed thereon. The intermediate conveying device 10 which is configured as a cycled transporter has several grippers 22 fastened on the circulating traction mechanism. The traction mechanism according to FIGS. 2 through 4 is comprised of an endless articulated chain 18 which is guided about a drive wheel 13 and a deflection wheel 14. According to FIGS. 2 and 4, at least in the area of the lower run, this articulated chain 18 is guided in a profiled guide rail 16 which is open in the downward direction and is U-shaped in cross-section. The articulated chain 18 has chain links 18' which, as illustrated, are approximately cross-shaped. Each has a downwardly extending arm 49 on which a gripping device 51 is fastened. The gripping devices 51 have a gripper 22 comprised of two gripping arms 27 and 28 which are fastened on a gear 23 and 24, respectively. These gears 23 and 24 mesh with one another and are rotatably supported on an axle 25, 26, respectively. The upper gear 24 according to FIG. 2 is connected to a two-arm lever 21 which, tensioned by the spring 52, rests against the roll 20 on a control rail 19. When the lever 21 is rotated about the axle 25 in the clockwise direction, the gripper 22 opens under the tension force of the spring 52. A pivot movement of the lever 21 in the counter-clockwise direction closes the gripper 22. By means of the control rail 19 the gripper 22 can be forced to open and can be closed by the spring force (52). As illustrated in FIG. 1, the grippers 22 in a side view have approximately a V-shape and two gripping elements 12 arranged at a spacing to one another and providing clamping locations with which the intermediate products 99 are gripped at their upper edge, respectively, wherein the intermediate products 99 are approximately centrally engaged by a clamping action at two clamping locations that are spaced from one another. The clamping force can be adjusted by the spring 52 to a pre-selected value. It is important in this connection that gripping of the intermediate products 99 at two spaced-apart locations enables a guiding action of the intermediate products in a position-stable way.

According to FIG. 4, an upwardly swinging knife 54, which is known in the art, is provided in order for the intermediate products 99 to be gripped at the upper fold 1*a* by one of the grippers 22, respectively. The knife 54 is arranged between the two chains 32, 33 in the area of the end 3*a* of the double conveying chain 3. This knife 54 is illustrated in FIG. 4 in an upper position. In another (lower) position, not illustrated, the knife 54 is positioned between the two chains 32 and 33. When emerging from this lower position, one intermediate product 99 is lifted, respectively, by the knife 54 into the position illustrated in FIG. 4. In this position, the intermediate product 99 is gripped by a gripper 22, and this gripper 22 is transferred from an open position into a closed position. This is controlled, as explained above, by the control rail 19 which pivots the lever 21. Once the intermediate product 99 has been gripped by the gripper 22, the knife 54 moves downwardly into the lower position between the chains 32, 33, and the intermediate product 99 is then transported in the direction of arrow 55 in FIG. 1 to the gather stitcher B. The transfer of the intermediate products 99 from the conveyor chain 3 to the intermediate conveying device 10 is carried out continuously and cycled.

In the gap 9 a guiding rail 31 is arranged which, according to FIG. 3, keeps the intermediate products 99 in an open position. This guiding rail 31 extends according to FIG. 1 with its arrow-shaped projection 31*a* into the area of the end 8*a* in which, as illustrated, the conveyor chain 8 of the second chain conveyor is lowered. The intermediate products 99 are transferred onto the conveying chain 8 in a spread-apart or open position by this projection 31*a*.

When the intermediate products 99 are located above the conveying chain 8, the corresponding gripper 22 is opened by the control rail 19 and the respective intermediate product 99 is thus released and dropped onto the conveyor chain 8 of the second chain conveyor where it is engaged by a follower 56 at its trailing end and is transported farther. According to FIG. 5, sheet feeders 39 are provided by means of which, as is known in the art, printed sheets, not illustrated, can be dropped onto the intermediate products transported on the conveyor chain 8.

In the conveying device 44 illustrated in FIG. 5, the gather stitchers A and B are arranged linearly and the collecting transport is carried out from the right to the left. The gather stitcher A comprises the sheet feeders 35 with which printed sheets are removed from a stack, not illustrated, and placed onto the single chain 2 of the first chain conveyor. In the area of the conveyor chain 3 which, as explained above, is a double conveying chain, already complete products can be stitched by the stitching machine 36, lifted off by means of the rotating delivery 4, and transported to a trimmer 37 where they are cut and subsequently supplied to a stacker 38.

Intermediate products 99 which are not yet complete are fed by means of the intermediate conveying device 10 to the gather stitcher B which has further sheet feeders 39 which can be identical to the sheet feeders 35. When the printed products are complete, they are stitched in the area of the double conveying and collecting chain by the stitching machine 40 and are supplied by means of a suitable delivery 4 for trimming to a trimmer 41 and subsequently to a stacker 42. The conveying device 44 is suitable particularly for so-called selective binding in which different printed products are produced successively. In this selective binding process the two gather stitchers A and B can also be combined with synchronized cycles. The delivery 4, the trimmer 37 and the stacker 38 are then switched off. The conveyor chains 2, 3 and the feeders 35 are then driven by the gather stitcher B. The two gather stitchers A and B can be operated, if desired, also independently from one another. The printed sheets 1 can be printed on the inner or outer sides, for example, to provide addresses, in the area of the single conveying chains 2 and 8 by means of, for example, an inkjet printer. The double conveying chain 3 and the corresponding double conveying chain of the gather stitcher B are less suitable for such printing actions.

Figure 6:
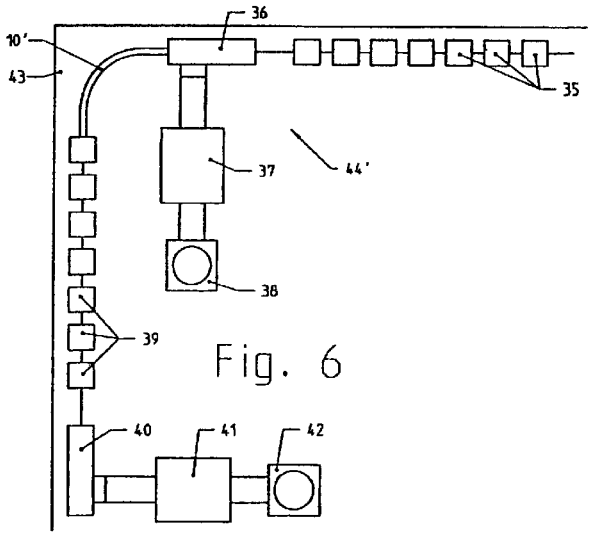
FIG. 6 shows a variant of the arrangement according to FIG. 5.

FIG. 6 shows a conveying device 44' in which the two gather stitchers A and B are arranged at a right angle to one another. The intermediate products, when using the conveying device 44' as a tandem gather stitcher, are deflected in an arc-shaped curve by 90° in the area of the intermediate conveying device 10'. This deflection is possible as a result of the flexibility of the intermediate conveying device 10', in particular, as a result of the flexible articulated chain 18. The guide rail 16 of the conveying device 10' is then also arc-shaped. The grippers 22 follow the correspondingly curved guide rail 16 wherein the gripped intermediate products 99 are thus deflected in a guided way. The right-angle embodiment has the advantage that the conveying device 44' can also be installed in the corner 43 of a building in a space-saving way.

Figure 7:
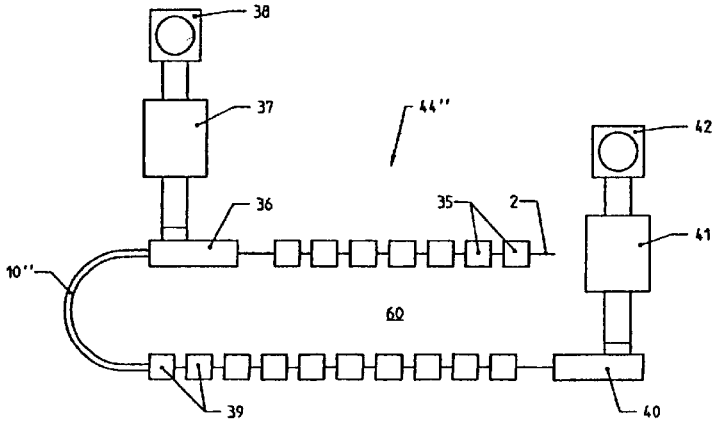
FIG. 7 shows schematically a further variant of an arrangement of the conveying device according to the invention.

FIG. 7 shows a conveying device 44" in which the gather stitchers A and B extends substantially parallel to one another and the intermediate products 99 are deflected in the area of an intermediate conveying device 10" by 180°. The operation of the sheet feeders 35 and 39 is realized between them in the area 60. Supply of the sheet feeders 35 and 38 is realized on opposite sides, i.e., the sheet feeders 35 are therefore supplied in FIG. 7 from above and the sheet feeders 39 from below. This is a very space-saving arrangement that is particularly suitable for large and long conveying devices.

While specific embodiments of the invention have been shown and described in detail to illustrate the inventive principles, it will be understood that the invention may be embodied otherwise without departing from such principles.

What is claimed is:

1. A conveying device for collecting and transporting printed sheets, the conveying device comprising:

a first chain conveyor on which the printed sheets are placed astraddle and conveyed in a conveying direction;

a second chain conveyor arranged downstream of the first chain conveyor in the conveying direction and synchronized with the first chain conveyor;

an intermediate conveying device arranged between the first and second chain conveyors and configured to grip intermediate products comprised of collected printed sheets formed at the end of a collecting process on the first chain conveyor and to transport and transfer the intermediate products onto the second chain conveyor;

wherein the intermediate conveying device comprises a circulating traction mechanism and controllable grippers connected to the traction mechanism;

wherein the controllable grippers are configured to grip a fold of the intermediate products lifted off the first chain conveyor and to transport the intermediate products in an open position to the second chain conveyor.

2. The conveying device according to claim 1, wherein the intermediate conveying device is a cycled transporter and wherein the traction mechanism is an articulated chain.

3. The conveying device according to claim 2, wherein the first chain conveyor has followers and wherein the grippers are arranged on the articulated chain at a spacing matching at least approximately a spacing of the followers on the first chain conveyor.

4. The conveying device according to claim 2, wherein the intermediate conveying device further comprises a profiled guide rail and wherein the articulated chain is guided in the profiled guide rail.

5. The conveying device according to claim 1, wherein the intermediate conveying device comprises a control device configured to open and close the grippers.

6. The conveying device according to claim 1, wherein the grippers are configured to grip the intermediate products at least at two locations spaced apart from one another.

7. The conveying device according to claim 1, wherein the second chain conveyor comprises a single or double conveying chain or a drag chain.

8. The conveying device according to claim 1, wherein the intermediate conveying device comprises a link chain or an articulated chain and is configured to convey along a linear path or a curved path.

9. The conveying device according to claim 8, wherein the intermediate products are deflected between the first and second chain conveyors by >0° to 180°.

10. The conveying device according to claim 1, wherein the first and second chain conveyors have correlated therewith a gather stitcher, respectively, comprising a stitching station and a delivery downstream of the stitching station.

11. The conveying device according to claim 1, further comprising a driven lifting knife arranged at one end of the first chain conveyor configured to lift the intermediate products to enable the intermediate conveying device to grip the intermediate products.

12. The conveying device according to claim 11, wherein the first chain conveyor comprises a double conveying chain comprising two chains wherein the lifting knife is arranged between the two chains and configured to be lifted and lowered between the two chains.

13. The conveying device according to claim 11, wherein the lifting knife has at least one cutout in an area engaging a fold area of the intermediate products, wherein the at least one cutout is configured to receive accommodate clamping locations of the grippers.

14. The conveying device according to claim 1, further comprising a guiding rail arranged in the area of the intermediate conveying device and configured to hold the intermediate products in the open position.

15. The conveying device according to claim 1, comprising at least two gather stitchers arranged inline, wherein the intermediate conveying device is configured to transport the intermediate products in a synchronized working cycle from one of the gather stitchers to another one of the gather stitchers.

* * * * *